US011489279B2

(12) United States Patent
Myer et al.

(10) Patent No.: US 11,489,279 B2
(45) Date of Patent: Nov. 1, 2022

(54) CONNECTOR FOR A FLAT FLEXIBLE CABLE

(71) Applicant: TE Connectivity Services GmbH, Schaffhausen (CH)

(72) Inventors: John Mark Myer, Middletown, PA (US); Hurley Chester Moll, Middletown, PA (US); Forrest Irving Kinsey, Jr., Middletown, PA (US)

(73) Assignee: TE Connectivity Solutions GmbH

( * ) Notice: Subject to any disclaimer, the term of this patent is extended or adjusted under 35 U.S.C. 154(b) by 0 days.

(21) Appl. No.: 17/096,039

(22) Filed: Nov. 12, 2020

(65) Prior Publication Data

US 2021/0408715 A1 Dec. 30, 2021

Related U.S. Application Data

(60) Provisional application No. 63/043,434, filed on Jun. 24, 2020.

(51) Int. Cl.

| | |
|---|---|
| ***H01R 13/436*** | (2006.01) |
| ***H01R 12/70*** | (2011.01) |
| ***H01R 12/77*** | (2011.01) |
| ***H01R 12/59*** | (2011.01) |
| ***H01R 12/65*** | (2011.01) |

(52) U.S. Cl.

CPC ..... *H01R 13/4361* (2013.01); *H01R 12/592* (2013.01); *H01R 12/65* (2013.01); *H01R 12/7023* (2013.01); *H01R 12/774* (2013.01); *H01R 12/778* (2013.01)

(58) Field of Classification Search

None

See application file for complete search history.

(56) References Cited

U.S. PATENT DOCUMENTS

| | | | | |
|---|---|---|---|---|
| 4,248,491 A * | 2/1981 | Mouissie | H01R 12/777 | 439/460 |
| 6,813,830 B2 * | 11/2004 | Saito | H01R 12/592 | 29/33 M |
| 7,467,970 B2 * | 12/2008 | Ikuta | H01R 12/592 | 439/496 |
| 9,531,104 B1 | 12/2016 | Park et al. | | |

FOREIGN PATENT DOCUMENTS

EP 1284524 A2 2/2003

OTHER PUBLICATIONS

International Search Report, Intl App No. PCT/IB2021/055627, dated Sep. 21, 2021, 3 pages.

* cited by examiner

*Primary Examiner* — Ross N Gushi

(57) ABSTRACT

A connector for a flat flexible cable or flat printed cable includes a housing portion and a plurality of terminals. The housing portion includes a plurality of terminal receiving passageways each receiving a contact portion of one of the plurality of terminals. A plurality of conductors exposed in a window extending through an insulation material of the flat flexible cable are each clamped in a terminating portion of one of the plurality of terminals by a clamping force applied thereon by a cover selectively fixable with respect to the housing portion.

19 Claims, 8 Drawing Sheets

CONNECTOR FOR A FLAT FLEXIBLE CABLE

CROSS-REFERENCE TO RELATED APPLICATIONS

This application claims priority under 35 U.S.C. § 119 to U.S. Provisional Patent Application No. 63/043,434, filed Jun. 24, 2020.

FIELD OF THE INVENTION

The present disclosure relates to a connector and, more particularly, to an electrical connector for a flat flexible cable or a flat printed cable.

BACKGROUND

As understood by those skilled in the art, flat flexible cables (FFCs) or flat flexible circuits are electrical components consisting of at least one conductor (e.g., a metallic foil conductor) embedded within a thin, flexible strip of insulation. Flat flexible cables, as well as similarly-configured flat printed cables (FPCs) are gaining popularity across many industries due to advantages offered over their traditional "round wire" counter parts. Specifically, in addition to having a lower profile and lighter weight, FFCs enable the implementation of large circuit pathways with significantly greater ease compared to round wire-based architectures. As a result, FFCs are being considered for many complex and/or high-volume applications, including wiring harnesses, such as those used in automotive manufacturing.

The implementation or integration of FFCs into existing wiring environments is not without significant challenges. In an automotive application, by way of example only, an FFC-based wiring harness would be required to mate with perhaps hundreds of existing components, including sub-harnesses and various electronic devices (e.g., lights, sensors, etc.), each having established, and in some cases standardized, connector or interface types. Accordingly, a critical obstacle preventing the implementation of FFCs into these applications includes the need to develop quick, robust, and low resistance termination techniques which enable an FFC to be connectorized for mating with these existing connections.

A typical FFC may be realized by applying insulation material to either side of a pre-patterned thin foil conductor, and bonding the sides together via an adhesive to enclose the conductor therein. Current FFC terminals include piercing-style crimp terminals, wherein sharpened tines of a terminal are used to pierce the insulation and adhesive material of the FFC in order to attempt to establish a secure electrical connection with the embedded conductor.

Due in part to the fragile nature of the thin foil conductor material, these types of terminals have several drawbacks, including much higher electrical resistances than conventional round wire F-crimps, inconsistent electrical connectivity between the conductor and the terminal, and mechanical unreliability over time in harsh environments. Further, a connector to which an FFC is terminated includes a plurality of terminals that each must be crimped to establish the electrical connection with the embedded conductor. Current FFC terminal connectors require complex equipment to terminate the crimp and are inefficient by requiring individualized crimping of the terminals.

Accordingly, there is a need for improved electrical connector assemblies and accompanying termination techniques for adapting FFCs and/or FPCs to these environments.

SUMMARY

In one embodiment of the present disclosure a connector for an FFC or FPC includes a housing defining a plurality of terminal receiving passageways. A plurality of conductive terminals of the connector each include a contact portion held in one of the plurality of terminal receiving passageways, and an exposed terminating portion configured to receive a conductor of an FFC. A plurality of conductors exposed in a window extending through an insulation material of the FFC are each clamped in the terminating portion of one of the plurality of terminals by a pressing or clamping force applied thereon by a cover or clamp housing selectively fixable to the housing.

According to another embodiment, a connector for an FFC or FPC comprises a first inner housing and a pair of second inner housings separate from the first inner housing. The first inner housing and the pair of second inner housings each have a plurality of terminal receiving passageways for receiving a plurality of terminals. Each terminal includes a contact portion held in one of the plurality of terminal receiving passageways and an exposed terminating portion. A plurality of segments of the FFC each have a plurality of conductors exposed in a window extending through an insulation material of the segment. The plurality of conductors of a first segment of the plurality of segments are each arranged in the terminating portion of one of the plurality of terminals in the first inner housing and the plurality of conductors of a pair of second segments of the plurality of segments are each arranged in the terminating portion of one of the plurality of terminals in the pair of second inner housings. Each of a first inner housing cover and a pair of second inner housing covers is selectively fixable to a respective inner housing in a clamping position and includes a plurality of clamping elements extending therefrom. The clamping elements are configured to clamp or press the plurality of conductors of the FFC within a respective one of the plurality of terminating portions of the terminals when the covers are fixed to the housings in the clamping position.

A connector assembly is also provided, and includes an FFC having an insulation material and a plurality of conductors embedded in the insulation material. The plurality of conductors may be partially exposed in a window extending through a portion of the insulation material in a clamping section thereof. A connector of the assembly comprises a housing and a plurality of terminals. The housing includes a plurality of terminal receiving passageways into which a contact portion of each of the plurality of terminals are held, and an exposed terminating portion. The plurality of conductors exposed in the window are each selectively clamped in electrical contact with the terminating portion of one of the plurality of terminals by a moveable clamp.

BRIEF DESCRIPTION OF THE DRAWINGS

The invention will now be described by way of example with reference to the accompanying Figures, of which.

DETAILED DESCRIPTION OF THE EMBODIMENTS

Figure 1:
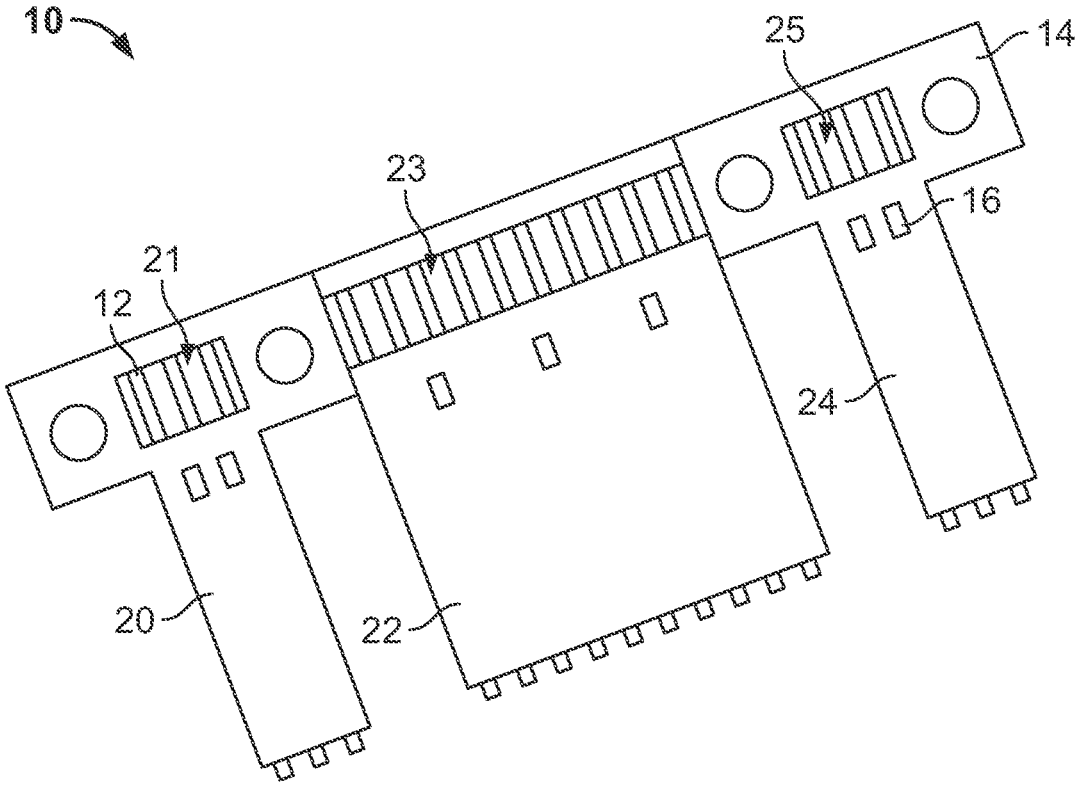
FIG. 1 is a perspective view of an exemplary FFC used with a connector assembly according to an embodiment of the present disclosure.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

Embodiments of the present disclosure include electrical connectors or connector assemblies configured to be mated to an FFC or FPC without the use of soldering or traditional crimping-type terminal connections. According to embodiments, each terminal of the connector includes a clamping or terminating portion having a U-shaped cross-section or other similar profile configured to receive a pre-exposed conductor of an FFC. More specifically, each terminal is secured to a housing of the connector, and the FFC positioned relative to the terminal such that one or more conductors thereof is arrange in, or aligned with, a respective terminating portion (also referred to herein as a "wire barrel"). A cover or clamp housing, either formed integrally with the housing or separate therefrom, is selectively fixable in a clamping position on the housing. In the clamping position, the clamp housing is configured to press or clamp each conductor into electrical contact with a respective terminating portion of each terminal. In one embodiment, pressing or clamping elements or fingers (also referred to as "stuffing elements") of the clamp housing bear against the conductors of the FFC, simultaneously pressing them into the terminating portions of the terminals as the clamp housing is fixed into the clamping position. The cover or clamp housing is selectively fixable relative to the connector housing such that in the clamping or attached position, constant pressure is applied and maintained on the conductors for establishing and retaining electrical contact with the terminals.

In related embodiments, multiple parallel rows of terminals can be accommodated by using an inner and outer housing. Plastic retention features can be molded into the connector housing and/or clamp housing that will work with pre-cut openings in the FFC to provide strain relief, and/or function to lock or latch the cover to the housing. In further embodiments, surfaces of the terminating portion or wire barrel and/or the clamping elements may define non-planar, roughened or serrated surfaces, including the presence of bumps, ridges or slotting for improving electrical contact with the conductor by penetrating and breaking through any surface deposits present thereon.

Connector assemblies according to embodiments of the present disclosure are configured for use with an FFC, such as the exemplary portion of an FFC 10 shown in FIG. 1. The FFC 10 generally includes a plurality of conductors 12 embedded within an insulation material 14. The conductors 12 may comprise metallic foil, such as copper foil on the order of 0.07 mm in thickness, by way of example only, patterned in any desirable configuration. The insulation material 14, such as a polymer insulation material, may be applied to either side of the conductors 12 via an adhesive material, resulting in an embedded conductor arrangement. The exemplary FFC 10 includes multiple segments 20,22, 24, each containing a plurality of conductors 12. Respective windows or openings 21,23,25 are selectively formed or defined proximate respective ends of the segments 20,22,24 for exposing the conductors 12, enabling connectorization thereof utilizing terminals and associated clamping or stuffing elements according to embodiments of the present disclosure. These and/or other windows or openings may be formed in the insulation material 14 in any desired location in order to expose portions of the conductors 12 for facilitating termination, improving mechanical connections and/or providing strain relief. For example, additional openings 16 may be provided and adapted to accept complementary features of associated connector or clamp housings, as will be described in further detail herein.

Figure 2:
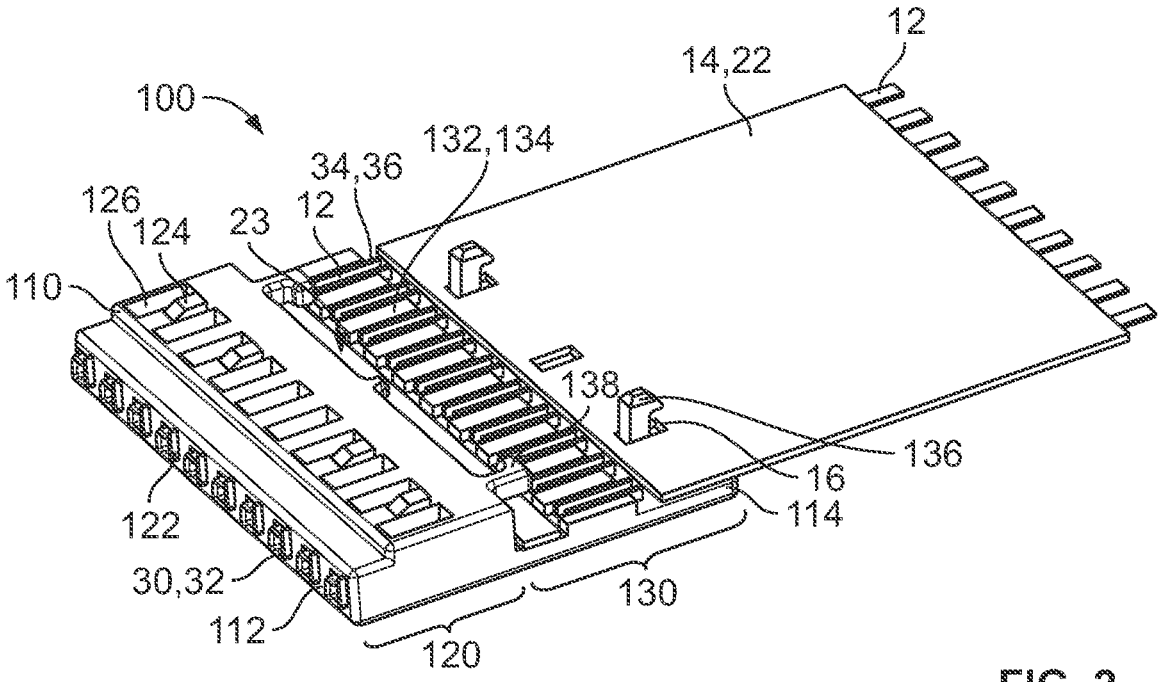
FIG. 2 is a perspective view of a first inner housing of the connector assembly including a plurality of terminals and an FFC in a pre-clamping position.

With reference to FIG. 2, a connector assembly 100 or subassembly forming a part of a mechanical connector is shown with a portion of the FFC 10 of FIG. 1 partially connected thereto. The connector assembly or inner housing assembly 100 includes a first inner housing or body 110 defining a mating end 112 and a rear end 114 oriented opposite the mating end in a longitudinal direction of the connector assembly. A mating section 120 is provided, generally beginning at the mating end 112 and extending toward the rear end 114 to a terminating or clamping section 130, which extends from the mating section to the rear end in the longitudinal direction. The mating section 120 may define a plurality of retention protrusions 124 for securing the inner housing 110 with an outer housing (e.g., outer housing 400 shown in FIG. 12) and a plurality of locking recesses 126. Each of the locking recesses 126 is aligned with one of a plurality of terminal receiving passageways 122 formed through the mating section 120, and is configured to receive a corresponding locking feature of a conductive terminal 30 for securing the terminal in a longitudinal direction within the receiving passageway.

Figure 4:
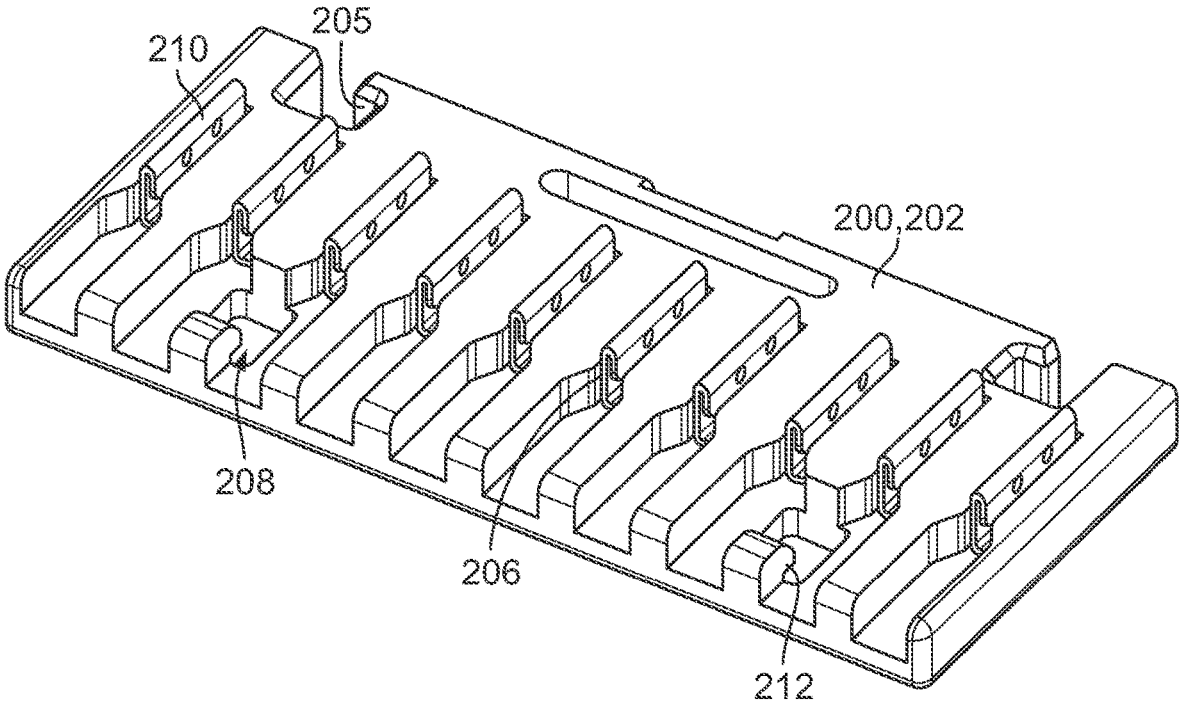
FIG. 4 is a perspective view of a clamping cover or clamp housing according to embodiments of the present disclosure.

The terminating or clamping section 130 has a base 132 defining a plurality of slotted recesses 134 extending in the longitudinal direction, with each recess aligning with a respective one of the terminal receiving passageways 122. The terminating section 130 has a plurality of locking or securing elements 136 extending from an exterior surface in the height direction. Each securing element 136 may comprise a latch, lever or hook-like protrusion defining a portion of a lock or latch assembly. In the illustrated embodiment, the securing elements 136 are positioned at the rear end 114. In other embodiments, the securing elements 136 may be positioned elsewhere on the base 132 along the longitudinal direction. In any position, each securing element 136 may extend from the inner housing 110 and through the corresponding opening 16 formed in the insulation material 14 of the FFC 10, thereby function as a form a strain relief for the FFC. A plurality of positioning features 138 are also provided or defined by the inner housing 110 and are configured to engage with corresponding features formed on a removable or moveable cover the connector assembly 100. More specifically, the securing elements 136 and the positioning features 138 are configured to selectively mate with corresponding features of a removable cover, clamp or clamp housing 200 as shown in FIG. 4 in order to align and secure the clamp housing to the first inner housing 110. In the exemplary embodiment, the first inner housing 110 is monolithically formed in a single piece from an insulative material, such as plastic.

Figure 3:
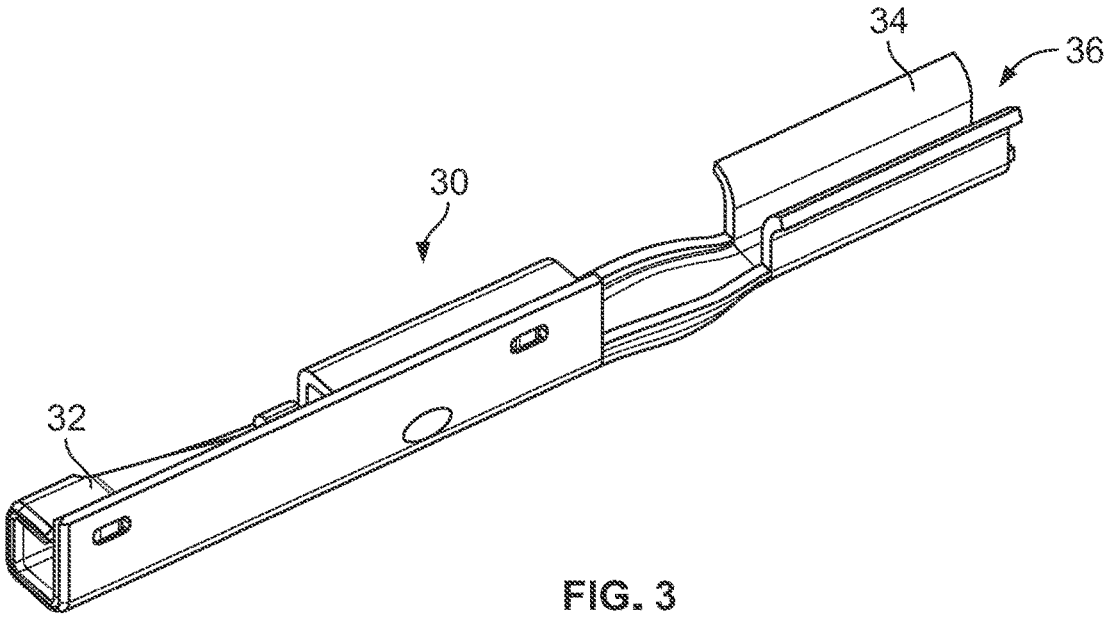
FIG. 3 is a perspective view of an exemplary terminal according to embodiments of the present disclosure.

Referring to FIGS. 2 and 3, the first inner housing 110 is pre-fitted with the plurality of the conductive terminals 30. Each terminal 30 generally includes an electrical contact or mating end 32, in this embodiment, a female mating end configured to receive a corresponding male terminal for establishing an electrical connection. However a male contact portion may be provided in another embodiment. A rear end 34 of the terminal 30 opposite the mating end 32 defines a terminating or clamping portion 36 defining a generally U-shaped receiving passage between opposing outwardly and vertically extending walls thereof. The mating ends 32 of the terminals 30 are received within a respective one of the plurality of terminal receiving passageways 122 in the longitudinal direction and into the illustrated installed position.

Likewise, each recess 134 of the terminating section 130 receives the terminating portion 36 of a respective terminal 30. As can be seen in FIG. 2, the terminating portions 36 are sized to at least partially extend through the openings 23 in the FFC 10, and receive the conductors 12 of the FFC therein. The FFC 10 is shown in FIG. 2 in an installed, pre-clamping position on the first inner housing 110, wherein the conductors 12 exposed in the opening 23 of the first segment 22 are positioned within the terminating portions 36 of the terminals 30 for subsequent clamping.

Referring now to FIGS. 4-10, embodiments of the present disclosure utilize clamp assemblies which work in conjunction with connector housings to secure the conductors of an FFC to their corresponding terminals. These arrangements avoid the time-consumption and reliability drawbacks associated with other terminating operations, such as soldering or crimping. With particular reference to FIG. 4, an exemplary clamp housing or cover 200 according to an embodiment of the present disclosure is shown. The clamp housing 200 comprises a body defining an underside 202 in which a plurality of slot-like openings 206 are defined. Each opening 206 receives and retains a corresponding one of a plurality of clamping elements or fingers 210, each configured to engage with an exposed surface of one of the conductors 12 of the FFC 10 (see FIG. 2) in an installed state of the clamp housing 200. In the exemplary embodiment, the clamping elements 210 comprise stamped, machined or otherwise formed metallic elements mechanically fixed to the clamp housing 200. The clamping elements 210 may be attached to the clamp housing in a removable and replaceable manner (e.g., secured via a friction fit connection).

Figure 5A:
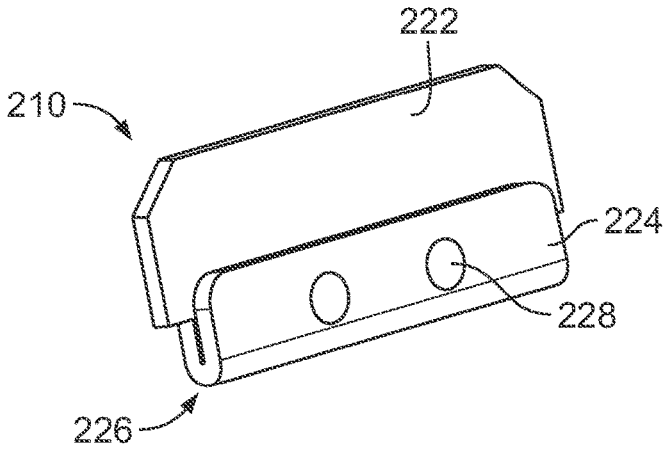
FIG. 5A is a perspective view of a clamping element of the clamp housing shown in FIG. 4.
Figure 5B:
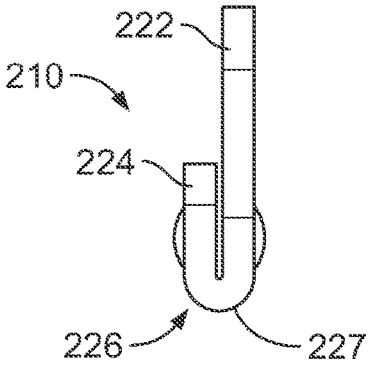
FIG. 5B is a cross-sectional view of the clamping element of FIG. 5A.

As shown in more detail in FIGS. 5A and 5B, in the exemplary embodiment, each clamping element 210 comprises a body including a planar portion having a first free end 222 configured to be inserted into a corresponding one of the openings 206 defined in the clamp housing 200, or molded therein during manufacturing of the housing. A conductor engaging portion 226 is defined between the first free end 222 and an opposite free end 224. The engaging portion 226 includes a "U" shaped folded section of the body defining a rounded or arcuate outer exterior surface 227 configured for engaging with a conductor 12. Preferable, the radius of curvature of the engaging portion 226 is sized so as to generally correspond with a rounded bottom clamping surface of the terminating portion 36 of the terminal 30, and is defined about an axis of curvature extending generally in a longitudinal direction of the conductor. One or more outward-facing sides of the engaging portion 226 define one or more features, such as protrusions 228 for engaging with the conductor 12 in the installed position of the clamp housing 200. The formation of the dome-shaped protrusions 228 on the clamping surface increases the pressure applied on the conductor 12 in these areas for ensuring sufficient electrical connectivity. These elements may also aid in breaking through any surface deposits present on the conductor, and/or increase the holding capacity of the conductor within the terminal 30. In other embodiments, these features may comprise recesses, ridges, serrations or other roughened or irregular surfaces without departing from the scope of the present disclosure. It should also be noted that the folded or overlapped configuration of the engaging portion 226 results in a resilient or elastic clamping end. In this way, more consistent pressure on the conductor is realized. Residual spring or elastic forces generated by the deformed conductor and/or the terminal and clamping elements act to maintain sufficient clamping forces such that end of life resistance requirements are satisfied.

Figure 6:
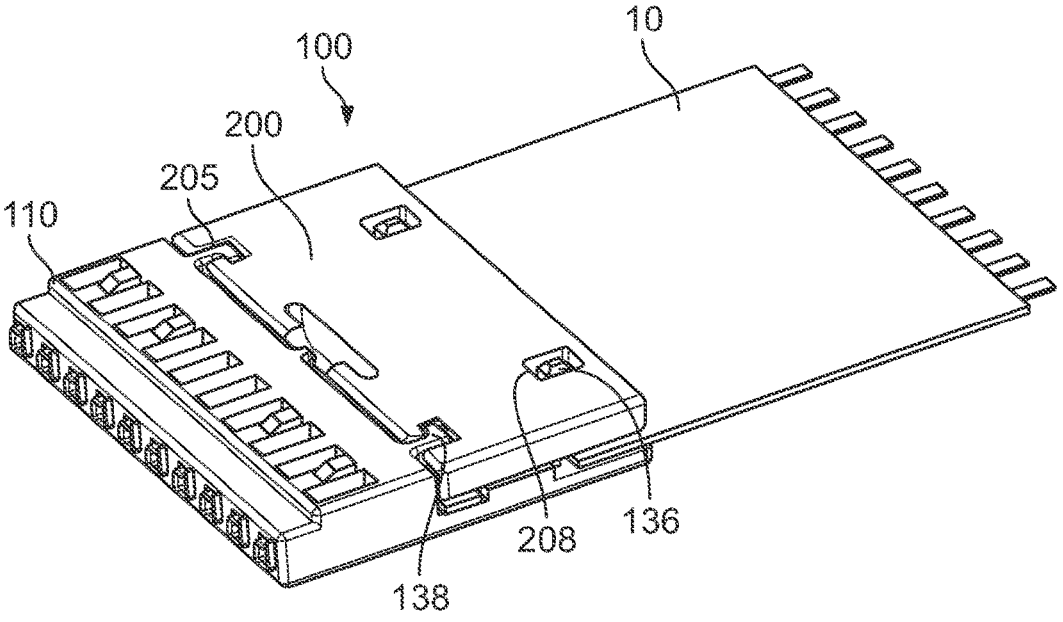
FIG. 6 is a perspective view of the first inner housing and the clamp housing in a clamped (or installed) state or position.

Referring again to FIG. 4, as well as to FIG. 6, the illustrated exemplary clamp housing 200 includes openings 208 corresponding in shape and location to the securing elements 136 of the first inner housing 110. More specifically, the hook or latch-like ends of the securing elements 136 are configured to engage or abut with corresponding opposing locking or latching surfaces 212 defined within the openings 208 of the clamp housing 200 when installed on the first inner housing 110, mechanically fixing the housings together and simultaneously clamping each of the exposed portions of the conductors 12 of the FFC 10 into electrical contact with a respective one of the terminating portions 36 of the terminals 30. Likewise, positioning openings 205 are configured to receive the positioning features 138 of the first inner housing 110 therein for ensuring maintained alignment of the clamp housing 200 relative to the first inner housing 110 in the installed position. It should be noted that the positioning openings 205 and positioning features 138 comprise surfaces which oppose each other along multiple planes extending in multiple directions (e.g., along a plane extending transverse to the connector and along a plane extending longitudinally relative to the connector). In this way, motion of the clamp housing 200 relative to the first inner housing 110 is limited by these connections in multiple directions (e.g., transverse and longitudinal motion).

Figure 7:
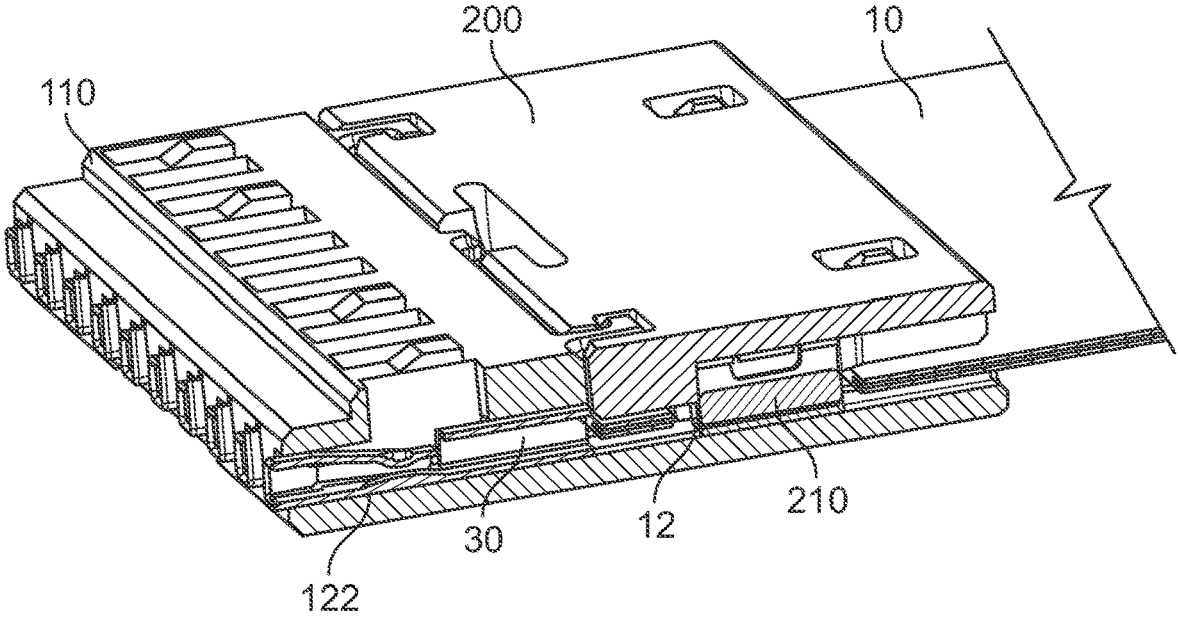
FIG. 7 is a cross-sectional view along a longitudinal direction of the first inner housing and the clamp housing as shown in FIG. 6.
Figure 8:
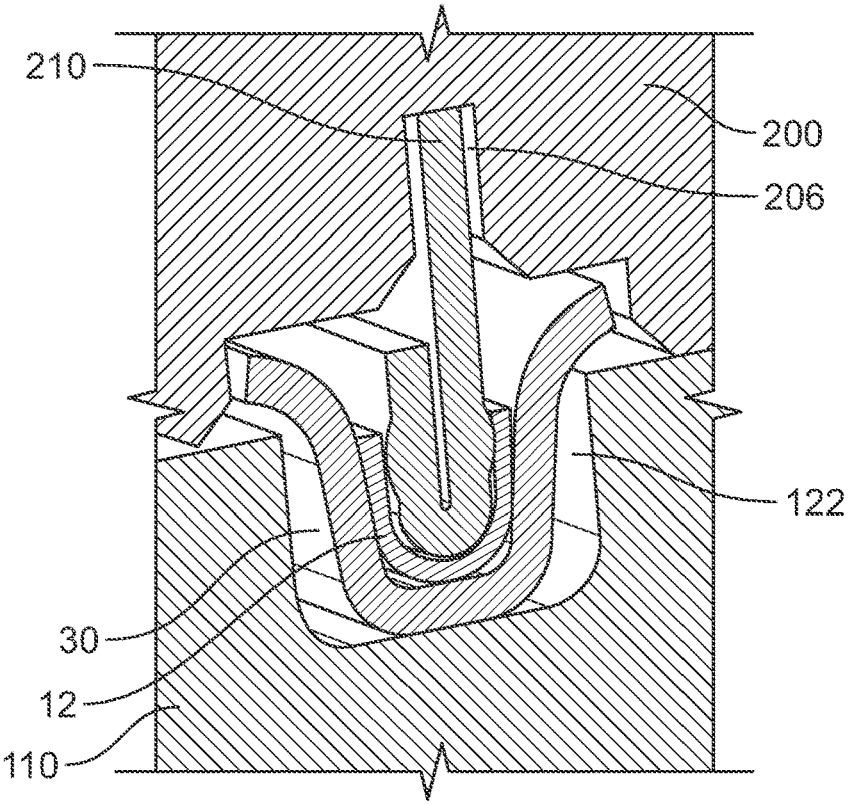
FIG. 8 is a cross-sectional view along a transverse direction of the first inner housing and the clamp housing as shown in FIG. 6.

Referring particularly to FIGS. 7 and 8, in the clamped or installed position, the clamping elements 210 act to compress and deform the conductors 12 into the base or bottom surface of the terminating portions 36 of the terminals 30. Moreover, as the conductors 12 are compressed, the sidewalls of each U-shaped engaging portion 226 are biased outwardly or horizontally in the illustrated orientation, further clamping the conductors 12 against the opposing sidewalls of the terminating portions 36, thus establishing a reliable electrical connection therebetween without the use of soldering or crimping. Moreover, as no plastic deformation of the clamping element 210 or terminal 30 is required, this clamped connection is easily releasable or reversible, facilitating disassembly of the connector assembly for repair or replacement, by way of example. Further still, the fixation of the clamp housing 200 relative to the first inner housing 110 is operative to clamp and secure portions of the insulation material 14 of the FFC 10 therebetween, providing additional mechanical strain relief.

Figure 9:
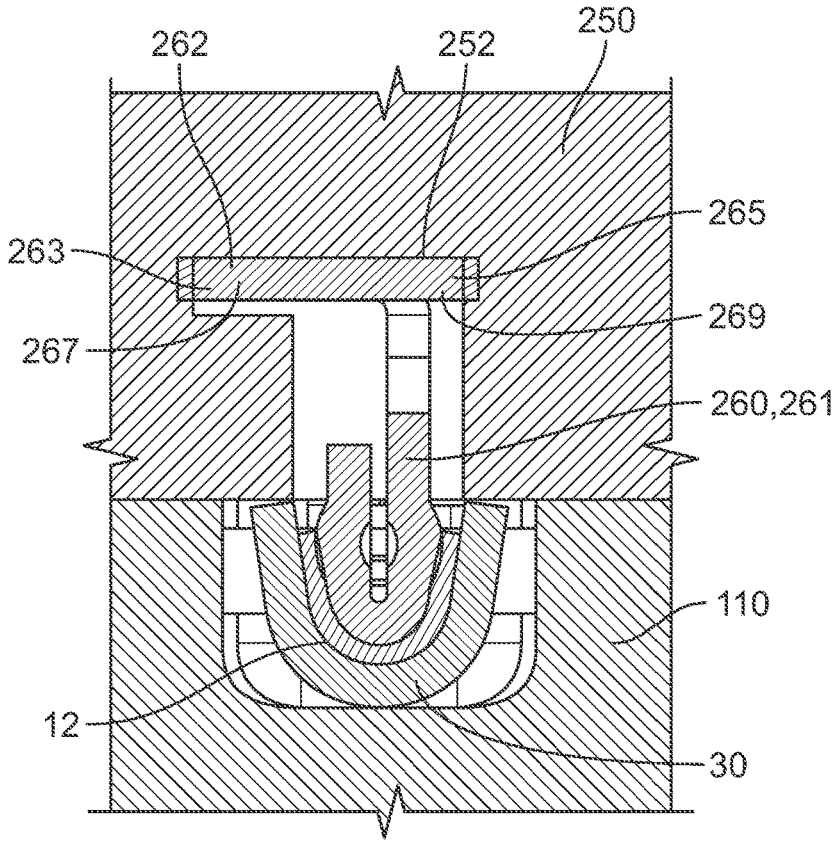
FIG. 9 is a cross-sectional view along a transverse direction of a first inner housing and a clamp housing according to another embodiment of the present disclosure.

FIG. 9 illustrates another embodiment of the present disclosure including a clamping element 260 having features similar to those set forth above in the embodiment of FIGS. 4-8. The clamping element 260 further includes a generally planar end 262 section oriented perpendicularly from a vertically extending central portion 261 thereof, and extending in a longitudinal direction of an associated clamp housing 250. The end section 262 comprises a width defined between free ends 263,265 thereof. As illustrated, the central portion 261 extends normally from the end section 262 at a position offset from a center thereof in the width direction, resulting in a first underside surface 267 of the free end 263 having a greater surface area compared to a second underside surface 269 of the free end 265. In this way, the clamping element 260 defines a generally "L" or "T" shaped cross-section. In the illustrated embodiment, the clamping element 260 may be secured to the clamp housing 250 by, for example, sliding the clamping element 260 in the longitudinal direction and through a corresponding slotted aperture 252 (such as an "L" or "T" shaped slotted aperture) defined in the clamp housing. In other embodiments, the clamping element 260 may be molded or mechanical stitched to the housing 250.

Figure 14A:
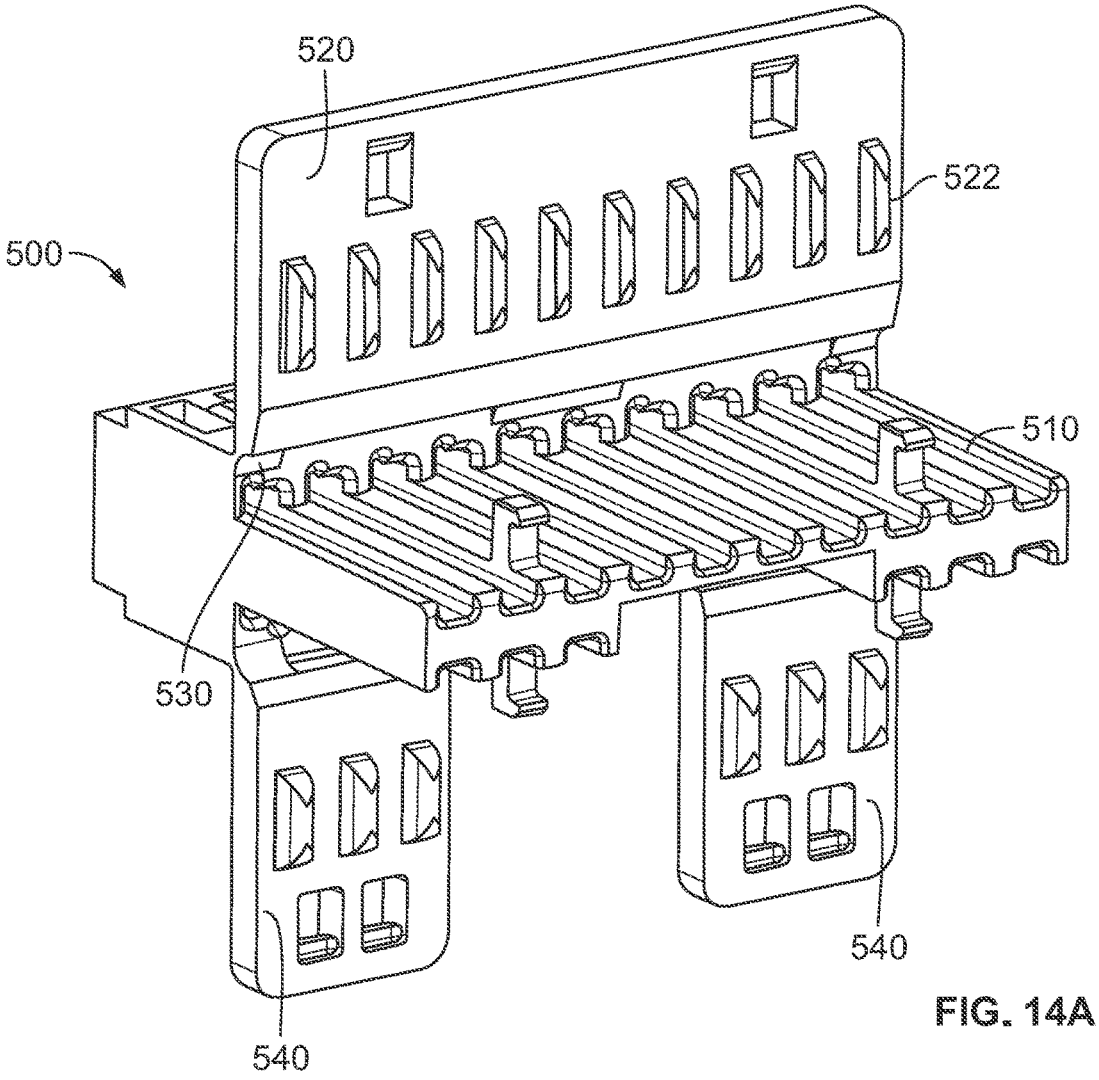
FIG. 14A is a perspective view of a connector housing according to another embodiment of the present disclosure in an unclamped or open position.
Figure 14B:
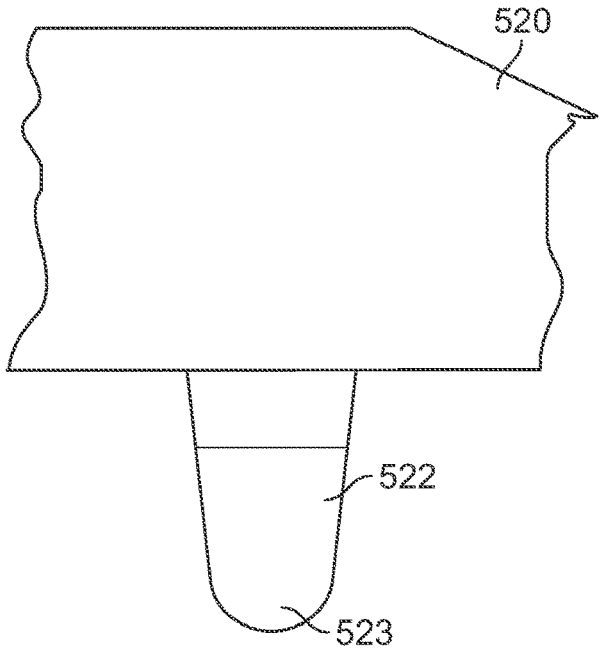
FIG. 14B is a partial view of a clamping element of the connector housing of FIG. 14A.

While each of the above embodiments includes a clamp housing or cover and a plurality of discrete clamping elements mechanically attached thereto, it should be understood that the clamp elements may be embodied as independently protruding portions of a single monolithic structure mechanically attached to the clamp housing. Likewise, the clamp elements may be formed integrally with the housing, as shown in the embodiment of FIGS. 14A and 14B.

Figure 10:
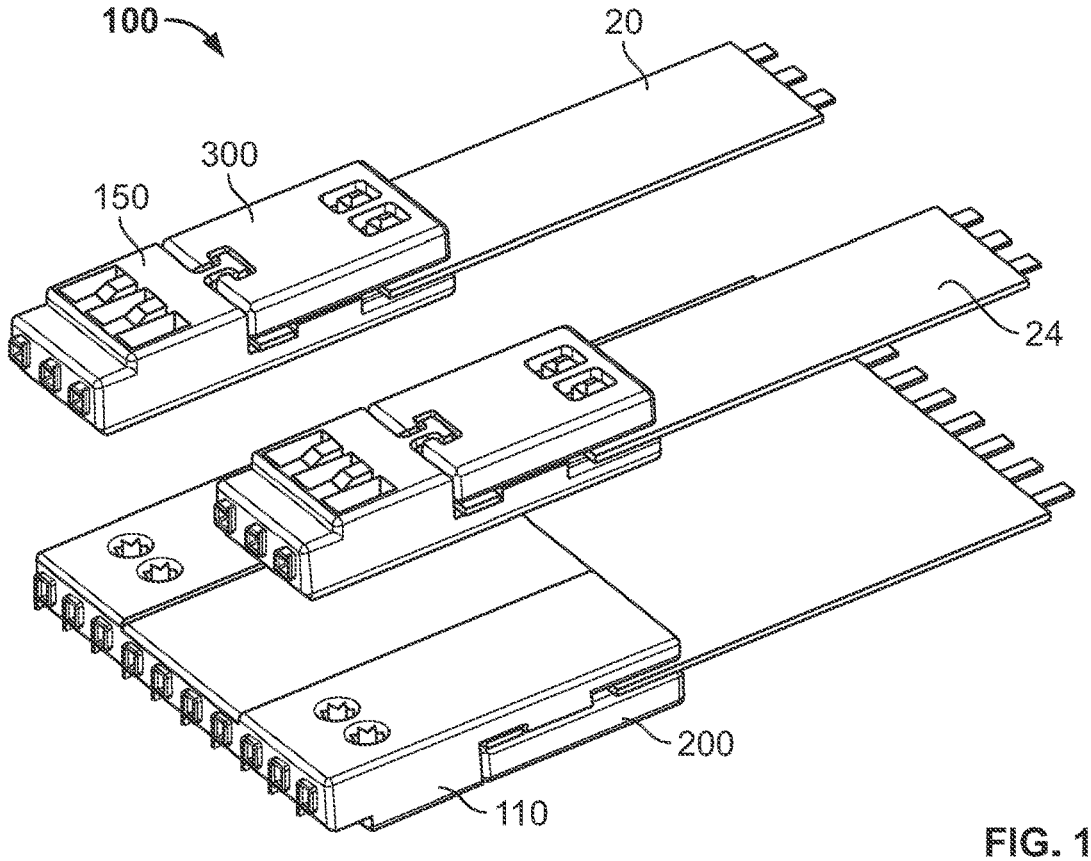
FIG. 10 is a perspective view of the first inner housing and a pair of second inner housings according to another embodiment of the present disclosure, with each in a clamped state.

Referring now to FIG. 10, an exemplary electrical connector according to an embodiment of the present disclosure includes a pair of second inner housings 150 separate from the first inner housing 110. The second inner housings 150 may be configured to mate with, for example, the remaining segments 20,24 of the FFC 10 as shown in FIG. 1. Each of the second inner housings 150 is structured similarly to the first inner housing 110, and receives a corresponding plurality of terminals 30 in the above-described manner. Likewise, each second housing 150 is fitted with a clamping cover or clamp housing 300, having features similar to those of the clamp housing 200, for electrically connecting the conductors 12 of the FFC 10 to the terminals arranged therein via clamping. Accordingly, additional details of the second inner housings 150 and associated clamp housings 300 are omitted herein for the purposes of brevity.

Figure 11:
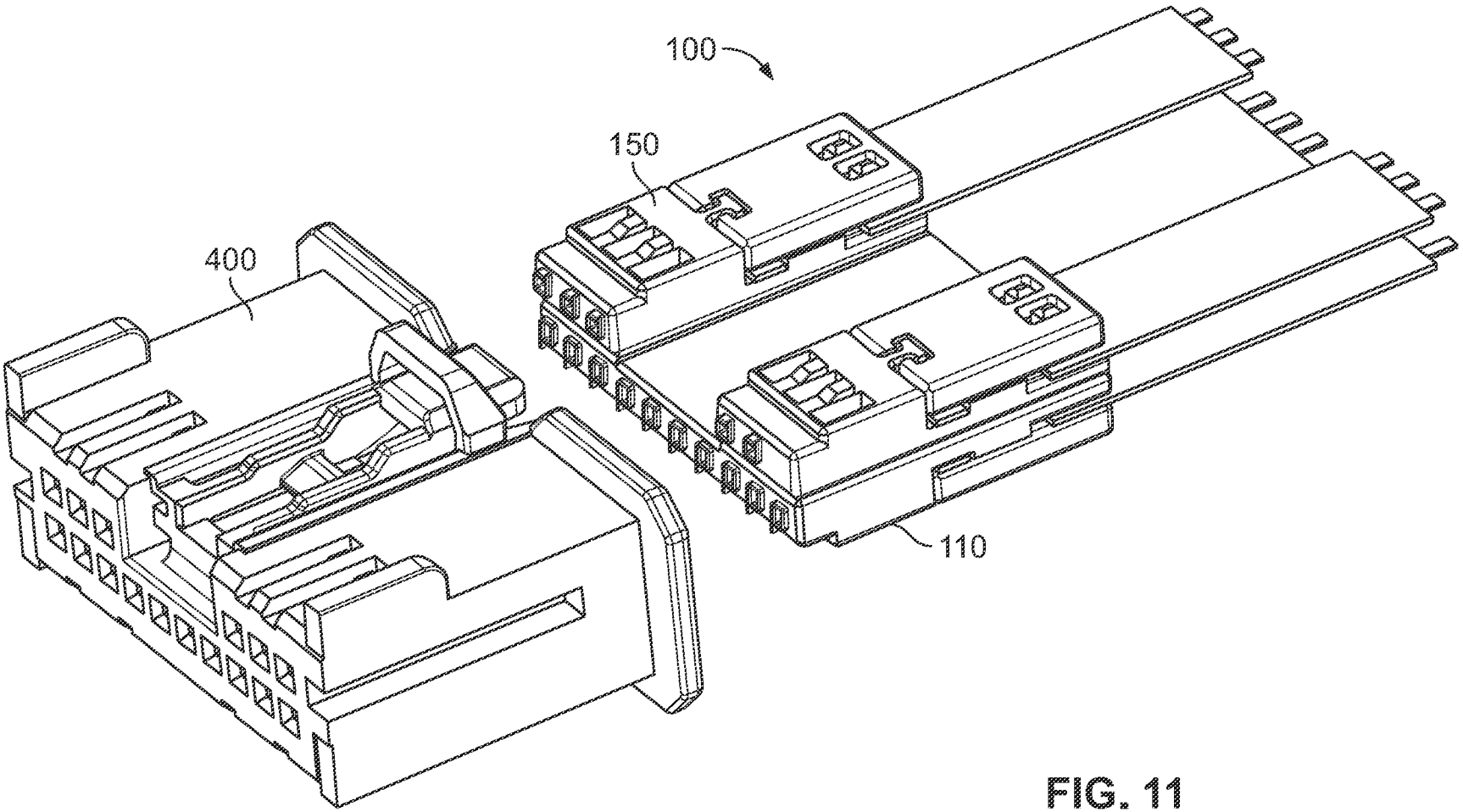
FIG. 11 is a perspective view of the first inner housing and the pair of second inner housings aligned for insertion into an outer housing according to an embodiment of the present disclosure.
Figure 12:
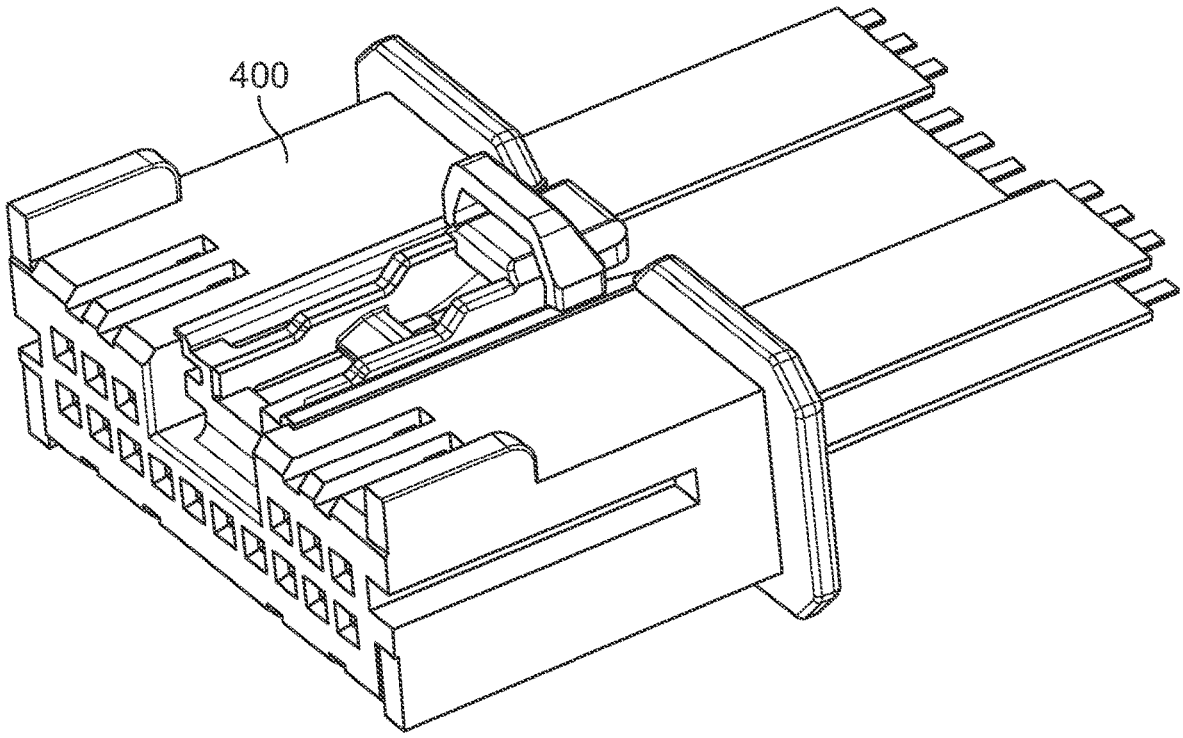
FIG. 12 is a perspective view of a connector assembly after the first inner housing and the pair of second inner housings shown in FIGS. 10 and 11 have been inserted into the outer housing.

Referring generally to FIG. 11, the use of separate first and second inner housings 110,150 facilitates ease of assembly of the electrical connector. Specifically, with the FFC 10 shown in FIG. 1, each of the segments 20,22,24 thereof may be fitted with a respective one of the first and second inner housings 110,150. Once connected therewith, the segments 20,24 and associated inner housings 150 may be folded over the first inner housing 110 and associated FFC segment 22, for forming the electrical connector profile illustrated in FIG. 11. With the first inner housing 110 and the second inner housings 150 aligned in an installation orientation shown, they may be inserted into an outer housing 400 as shown in FIG. 12. In the exemplary embodiment, the outer housing 400 comprises one half of an electrical connector configured to mate with a corresponding other half for establishing electrical connections between the FFC 10 and other components.

Figure 13:
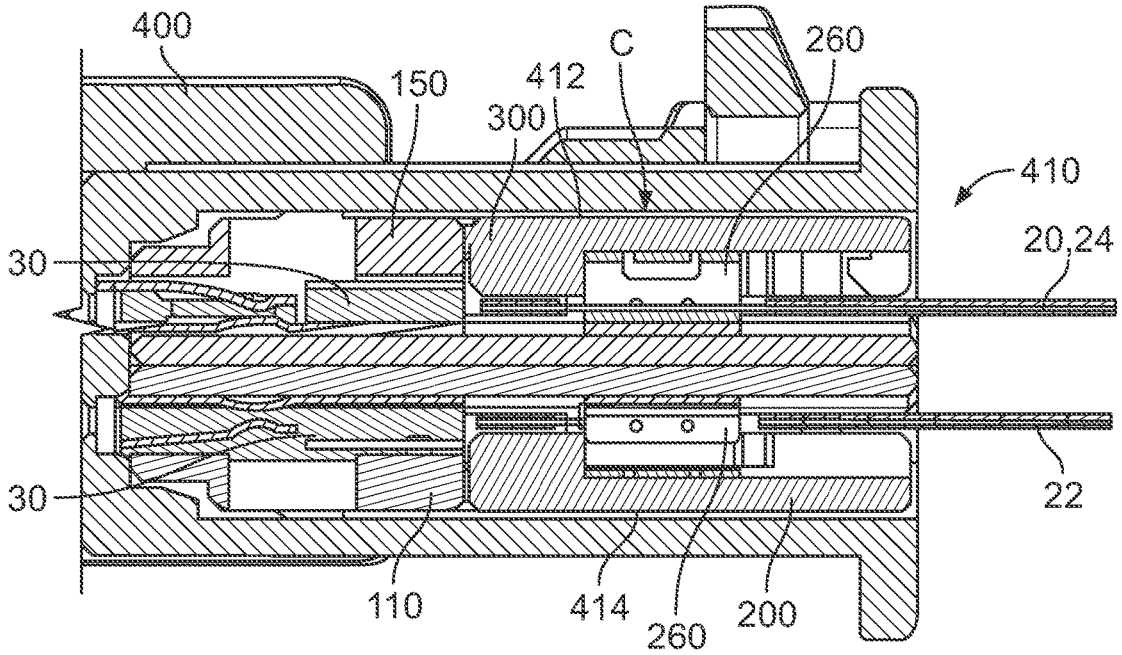
FIG. 13 is a cross-sectional view along the longitudinal direction of the connector assembly of FIG. 12.

FIG. 13 provides a cross-sectional view of the assembled connector 400, wherein the conductors 12 of respective FFC segments 20,22,24 are clamped to respective terminals 30 via the clamp housings 200,300 and their associated clamping elements. As shown, an insertion opening 410 of the outer housing 400 may be sized such that opposing inner walls 412,414 thereof place an opposing compressive force C on each of the clamp housings 200,300 in a direction generally towards a center of inner housing assembly 100. In this way, the outer housing 400 is configured to generate and maintain a compressive force on the conductors 12 by continuously bearing on the clamp housings and associated clamping elements in the installed state or position.

Referring generally to FIGS. 14A and 14B, in an alternate embodiment of the present disclosure, a single clamping connector or connector housing 500 is provide which may replace the separate first and second inner housings 110,150, as well as the clamp housings 200,300 in the above embodiments. In particular, the detachable clamp housings may be replaced with respective covers 520,540 moveably attached to respective sides of the housing 500. In one embodiment, the cover 520 is movably attached to the housing 500, such as by a hinge or other pivoting connection 530 (e.g., a living hinge as shown), such that it is moveable between an unclamped or open position as shown, and a clamped position. The cover 520 may be a separate, discrete element pivotally or otherwise moveably attached to the housing 500, or may be formed integrally therewith as shown. The additional details of the housing 500 are sufficiently described above, with features corresponding to those of the inner housings, the clamp housings, and the FFC, and are not repeated herein for the purpose of brevity.

As is clear from the figures, in the clamped position, clamping elements or protrusions 522 formed on an underside of the cover 520 will engage with conductors of an FFC arranged on a base 510 for compressing the conductors into electrical contact with respective terminals, as described above with respect to the preceding embodiments. As set forth above with respect to the clamping elements 210, the clamping elements 522 may define rounded free ends 523 generally corresponding in shape to a terminating portion of a terminal into which they compress a conductor. The cover 520 may be fixed in the clamped position via the hinged connection and the illustrated locking or latching features, such as those described above with respect to FIGS. 4-8.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range.

Also, the indefinite articles "a" and "an" preceding an element or component of the invention are intended to be nonrestrictive regarding the number of instances, that is, occurrences of the element or component. Therefore "a" or "an" should be read to include one or at least one, and the singular word form of the element or component also includes the plural unless the number is obviously meant to be singular.

The term "invention" or "present invention" as used herein is a non-limiting term and is not intended to refer to any single embodiment of the particular invention but encompasses all possible embodiments as described in the application.

What is claimed is:

1. A connector for a flat flexible cable, comprising:

a housing having a plurality of terminal receiving passageways;

a plurality of terminals each having a contact portion held in one of the plurality of terminal receiving passageways and an exposed terminating portion; and a cover selectively fixable to the housing in a clamping position, the cover including a plurality of discrete clamping elements extending therefrom and configured to simultaneously clamp each of a plurality of conductors of the flat flexible cable within a respective one of the plurality of terminating portions when the cover is fixed to the housing in the clamping position, each of the plurality of clamping elements defines a protruding elongated clamping surface which includes a rounded surface for engaging with the conductor, the rounded surface having a radius of curvature defined about an axis extending in a longitudinal direction of a respective one of the plurality of conductors and positioned to engage with one of the plurality of conductors arranged within the terminating portion of the terminal, wherein the conductor is clamped along the longitudinal direction between the clamping surface and an opposing surface of the terminating portion with the cover in the clamping position.

2. The connector of claim 1, wherein the housing comprises a base defining a plurality of recesses for receiving the plurality of terminals.

3. The connector of claim 1, wherein the clamping surface of each of the plurality of clamping elements defines a protrusion extending in a direction transverse to the longitudinal direction of a respective one of the plurality of conductors.

4. The connector of claim 1, wherein each of the terminating portions comprises a generally C-shaped cross-section defining an open side, each of the protruding elongated clamping surfaces is inserted into the open side of the terminating portion along the longitudinal direction of the respective conductor as the cover is placed in the clamping position.

5. The connector of claim 1, further comprising a locking mechanism for fixing the cover in the clamping position relative to the housing.

6. The connector of claim 5, wherein the locking mechanism comprises a latch defined on one of the cover or the housing.

7. The connector of claim 6, wherein the latch extends through a corresponding opening in an insulation material of the flat flexible cable.

8. The connector of claim 5, further comprising at least one positioning feature defined on at least one of the housing or the cover for aligning the cover with respect to the housing in the clamping position.

9. The connector of claim 8, wherein the positioning feature comprises a protrusion defined by one of the cover or the housing and a complementary recess defined by the other one of the cover or the housing.

10. The connector of claim 1, wherein the plurality of conductors are exposed in a window extending through an insulation material of the flat flexible cable, wherein in the clamping position, the cover is configured to engage with the insulation material for fixing the position of the flat flexible cable relative to the housing.

11. The connector of claim 1, wherein the cover is hingedly attached to the housing.

12. The connector of claim 1, wherein the cover is removably attached to the housing.

13. The connector of claim 1, wherein the housing comprises a base defining a plurality of recesses extending in the longitudinal direction of each of the plurality of conductors, each recess receiving a respective one of the plurality of terminals, each of the terminating portions of the plurality of terminals comprises a cross-section having an open side extending in the longitudinal direction of each of the plurality of conductors, the clamping element inserted into the open side in a direction transverse to the longitudinal direction of each of the plurality of conductors as the cover is placed in the clamping position.

14. A connector for a flat flexible cable, comprising:

a first inner housing and a pair of second inner housings separate from the first inner housing, the first inner housing and the pair of second inner housings each having a plurality of terminal receiving passageways;

a plurality of terminals each having a contact portion held in one of the plurality of terminal receiving passageways and an exposed terminating portion, a plurality of segments of the flat flexible cable each have a plurality of conductors exposed in a window extending through an insulation material of the segment, the plurality of conductors of a first segment of the plurality of segments are each arranged in the terminating portion of one of the plurality of terminals in the first inner housing and the plurality of conductors of a pair of second segments of the plurality of segments are each arranged in the terminating portion of one of the plurality of terminals in the pair of second inner housings; and a first inner housing cover and a pair of second inner housing covers, each of the housing covers selectively fixable to a respective inner housing in a clamping position and including a plurality of clamping elements extending therefrom and configured to clamp each of the plurality of conductors of the flat flexible cable within a respective one of the plurality of terminating portions of the terminals when the covers are fixed to the housings in the clamping positions.

15. The connector of claim 14, wherein the pair of second inner housings are attached to the first inner housing in an assembled position in which the plurality of terminals are positioned in a pair of rows separated from one another in a direction perpendicular to a longitudinal direction of the plurality of terminals.

16. The connector of claim 15, further comprising an outer housing having an inner housing receiving passageway receiving the first and second inner housings in the assembled position.

17. A connector assembly, comprising:

a flat flexible cable having an insulation material and a plurality of conductors embedded in the insulation material, the plurality of conductors exposed in a window extending through a portion of the insulation material; and a connector including a housing and a plurality of terminals, the housing having a plurality of terminal receiving passageways, the plurality of terminals each having a contact portion held in one of the plurality of terminal receiving passageways and an exposed terminating portion, each of the plurality of conductors exposed in the window is clamped in electrical contact with the terminating portion of one of the plurality of terminals by a respective one of a plurality of clamping elements, a clamping surface of each of the plurality of clamping elements comprises a rounded surface for engaging with a conductor in which the rounded surface has a radius of curvature defined about an axis extending in a longitudinal direction of the conductor, further includes an elongated protrusion defining a corresponding elongated clamping surface extending in the longitudinal direction of a respective one of the plurality of conductors and positioned to engage with one of the plurality of conductors arranged within the terminating portion of the terminal, the conductor clamped along the longitudinal direction between the clamping surface and an opposing surface of the terminating portion.

18. The connector assembly of claim 17, further comprising a cover selectively fixable with respect to the housing, wherein the plurality of clamping elements are defined on the cover, each of the clamping elements insertable into a respective one of the termination portions of the plurality of terminals for applying a compressive force on the conductor arranged therein.

19. The connector assembly of claim 17, wherein the plurality of clamping elements are separated from one another in a direction transverse to the longitudinal direction of each of the conductors.

* * * * *